United States Patent [19]

Crosby

[11] 4,157,172

[45] Jun. 5, 1979

[54] SEAT BASE RAIL CONNECTOR AND ASSEMBLY

[75] Inventor: Lawton H. Crosby, Lake Bluff, Ill.

[73] Assignee: Morley Furniture Spring Corporation, Chicago, Ill.

[21] Appl. No.: 865,967

[22] Filed: Dec. 30, 1977

[51] Int. Cl.[2] ..... F16F 3/02

[52] U.S. Cl. ..... 267/110

[58] Field of Search ..... 267/99, 101, 110–112

[56] References Cited

U.S. PATENT DOCUMENTS 3,276,765 10/1966 Slominski et al. ..... 267/111

*Primary Examiner*—Duane A. Reger

*Attorney, Agent, or Firm*—Richard G. Lione

[57] ABSTRACT

A rail connector and improvement in seat base support assembly. The connector, in its simplest form, comprises a generally V-shaped body fabricated of spring steel wire, the body having diverging side legs and then rail attachment and spring attachment legs extending in opposite directions from the free ends of the side legs. The rail-attachment leg or legs may be fixed to the rail, pivotally attached thereto, or attached in articulated fashion. The spring-attachment leg may be pivotally connected to the seat base support means or, particularly where a sinuous spring band is involved reach up into the band. Varying the side leg dimensions varies the seat base performance.

4 Claims, 16 Drawing Figures

SEAT BASE RAIL CONNECTOR AND ASSEMBLY

FIELD OF THE INVENTION

This invention is in the field of seat base support assemblies. It relates to seat base support assemblies for furniture or the like wherein the support assemblies employed are of the non-spring type; i.e., they comprise sinuous spring bands, wire grids or chord-rubber webbing, or are made up of flexible steel bands. The invention finds particularly advantageous application to sinuous band seat spring assemblies, however, and is discussed initially in that context.

BACKGROUND OF THE INVENTION

For over thirty years it has been conventional to employ helical spring connectors of various sizes and lengths to connect sinuous spring bands to rails of furniture seat frames. In fact, most high quality sinuous seat spring assemblies in upholstered furniture manufactured during this period have incorporated helical spring connectors.

Helical spring connectors have shortcomings, however, which have been exacerbated by new technical developments and by the rising costs occasioned by the use of helicals, both in labor and materials, during the past few years. Specifically, the sinuous seat spring developments disclosed in Crosby U.S. Pat. No. 3,210,064, and Crosby et al. U.S. Pat. Nos. 3,388,904, and 3,525,514, produce greatly increased comfort through the development of leverage-amplification, torsioning and compression in the body of each band and moment-arm-induced-dropping of the band adjacent the back rail of the seat frame. These developments add to the cost of the seat spring assemblies but their luxury producing effects are so substantial that manufacturers have readily adopted them.

Against this background, although helical spring connectors do provide comfort input to the spring assemblies, their substantial and constantly rising cost now make their percentage contribution to the overall cost of the furniture piece far out of proportion to the amount of comfort input they provide; i.e., for their substantial expense they do not play a big enough role in the final seat spring performance. Furthermore, the inherent shortcomings of helical spring connectors, historically overlooked, such as noise sometimes caused by relative movement between the connector ends and the spring bands or rail clips, have magnified the manufacturers' distaste for such connectors in light of their other shortcomings.

SUMMARY OF THE INVENTION

An object of the present invention is to provide a new and improved rail connector for sinuous spring bands, wire grids, chord-rubber webbing, and flexible steel bands.

Another object is to provide a rail connector which embodies the salutary features of conventional helical spring connectors while retaining essentially none of the undesirable features thereof.

Still another object is to provide a rail connector which produces easily controllable resilience or elasticity in the connection between the spring and the rail.

Yet another object is to provide a rail connector which is capable of producing leverage-amplification, torsioning, and compression in the body of a sinuous spring band which it connects to the frame rail.

A further object is to provide a rail connector which is capable of producing a torsion or moment-arm-induced dropping of a sinuous band adjacent to the back rail to give a luxury feeling to the seat which is known in the industry as "deep-drop".

Still a further object is to provide a rail connector which can selectively locate the height of suspension relative to the rail.

Another object is to provide a rail connector which is substantially less expensive than conventional helical connectors which are presently in use.

Another object is to provide sinuous spring band and rail connector combinations which produce unexpectedly high levels of seat spring comfort in an upholstered furniture seat base.

The foregoing and other objects are realized in accord with the present invention by providing a new rail connector configuration. In its simplest form it comprises a generally V-shaped body fabricated of an eight (8) gauge or heavier spring steel wire. The body includes a rail-side leg and a spring-side leg which are joined at an apex and diverge to corresponding free ends. The connector also includes a normally horizontal rail-attachment leg which extends from the free end of the rail-side leg toward the rail, to which it is mated in one of several ways. The connector further includes a spring-attachment leg which extends toward the band, to which it is mated.

The rail connector embodying this invention which finds truly practical application is much more sophisticated and can be modified in many ways to give selective performance and effect in a sinuous spring band assembly. This connector comprises two connector arms unitarily fabricated from a single piece of heavy gauge spring steel wire. Each connector arm includes a generally V-shaped body having a rail-side leg and a spring-side leg which are joined at an apex and diverge to corresponding free ends. Each arm further includes a normally horizontal rail-attachment leg which extends from the free end of the corresponding rail-side leg toward the rail and a spring-attachment leg which extends toward and mates with the band. The rail attachment legs are joined together at their free ends by a transversely extending base-leg.

In its most widely used form the base-leg is pivotally connected to the frame rail, either directly or through an articulate link. In the case of the link connection, the articulation introduced permits the connector to translate in downward movement as a subject is seated on the spring assembly; i.e., the back end of the spring band both pivots and drops downwardly. The effect of this "initial drop", as it is called, is to add further to the luxury action of the spring assembly, as it is called, in a manner which will hereinafter be discussed.

The rail-attachment legs of the rail connector may be varied in length. In practice, they are varied to suit different dimension of the frame and available spring bands. In effect, a manufacturer can use a smaller inventory of sinuous spring band lengths to fit a much larger repertoire of frame sizes.

The rail-side legs and the spring-side legs can also be varied in length relative to each other. When the spring-side legs are longer than the rail-side legs, the connector is effectively more elastic; i.e., that is a softer feeling results than when equal length rail-side legs and spring-side legs are employed. When the rail-side legs are made longer than the spring-side legs, the effect is to make the connector less elastic and provide a firmer connection.

As a corrolary to the immediately aforedescribed differential relationship between the lengths of the rail-side legs and the spring-side legs, when the spring-side legs are shorter the effect is also to drop the rear end of the spring band commensurately. This drops the point of spring suspension relative to the back rail and, as a result, controls the front to back pitch of the spring band. This determines the profile of the furniture seat when completed and has considerable effect on furniture base design from an aesthetic standpoint, as well as on spring action from a performance standpoint.

The free ends of the spring-attachment legs carry either downwardly or upwardly bent hooks. When downwardly-bent, they may be attached directly to the ultimate linear segment in the sinuous spring band. They may also reach up into the spring band to attach to the penultimate linear segment, or other. As another alternative they may be attached to a separate torsion member, such as disclosed in the aforementioned Crosby U.S. Pat. No. 3,210,064. When upwardly bent they may be attached directly to the ultimate linear segment of a sinuous spring or connected thereto with an interposed VL clip.

When the spring-attachment legs reach up into the body of the band, they overlie an inner linear segment of the band and underlie the ultimate linear segment. This arrangement produces arc-chord compression in the sinuous spring band toward the center area of the band, a highly desirable effect as has been discussed in the immediately aforementioned co-pending application.

At the same time, the spring-attachment leg extending downwardly and outwardly of the ultimate loop in the spring band introduce a torsion effect or moment in the back end of the band. This produces a certain amount of the aforementioned "deep-drop" when a subject is seated and the luxury feeling which ensues. In this regard, the spring-attachment legs are normally inclined upwardly relative to the horizontal in the free state. Control of the angle of incline has the effect of controlling the amount of torsion-force which is introduced to the rear end of the spring band. The greater the angle and the further the spring-attachment legs extend below the band end, the greater the torsion force.

If the spring side legs are longer than the rail-side legs a major torsion-force or moment is introduced in the back of the band. This produces a great amount of "deep-drop" of the band assembly at its rear end when a subject is seated, a highly desirable result in certain types of furniture.

By attaching the rail connectors embodying certain features of the invention through torsion arms formed either separately from the band or unitarily therewith, a torque-upon-torque relationship is created; i.e., there are coupled torques acting on the rear end of the spring band. Obviously, the construction, because of the number of components and their manufacturing cost, is more expensive. However, it produces an even greater "deep-drop" in the back end of the band and an even greater compression in the control area of the spring, and with it concomitantly greater luxury.

In a more restricted but nevertheless advantageous form, the base leg and rail attachment legs are fixedly secured to the back frame rail. In this form the rail connector does not pivot on the rail, of course.

BRIEF DESCRIPTION OF THE DRAWINGS

The invention, including its construction and modes of operation, together with additional objects and advantages thereof, is illustrated more or less diagrammatically in the drawings, in which.

DESCRIPTION OF THE PREFERRED EMBODIMENTS

Figure 1:
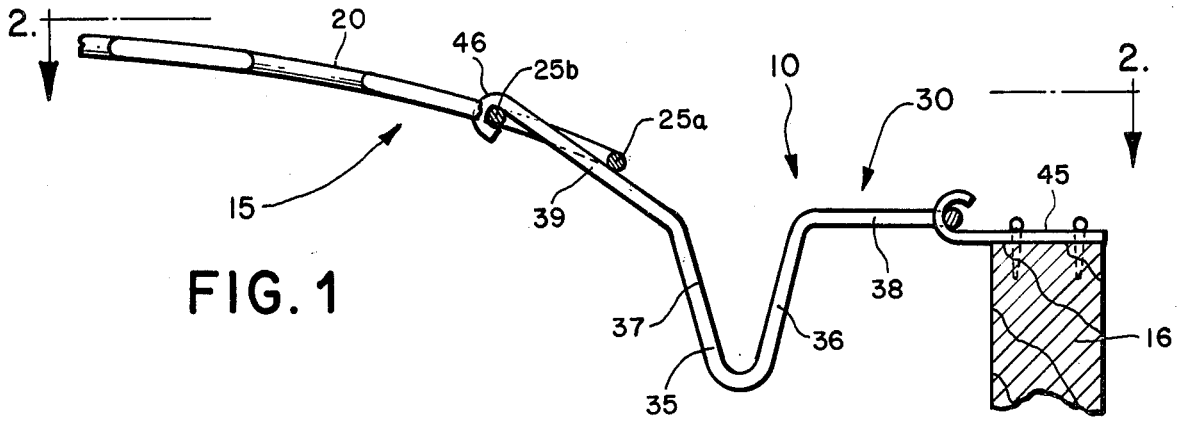
FIG. 1 is a vertical sectional view through a portion of the back end of a furniture seat spring base, illustrating a spring band assembly including a first form of rail connector embodying features of the present invention.
Figure 2:
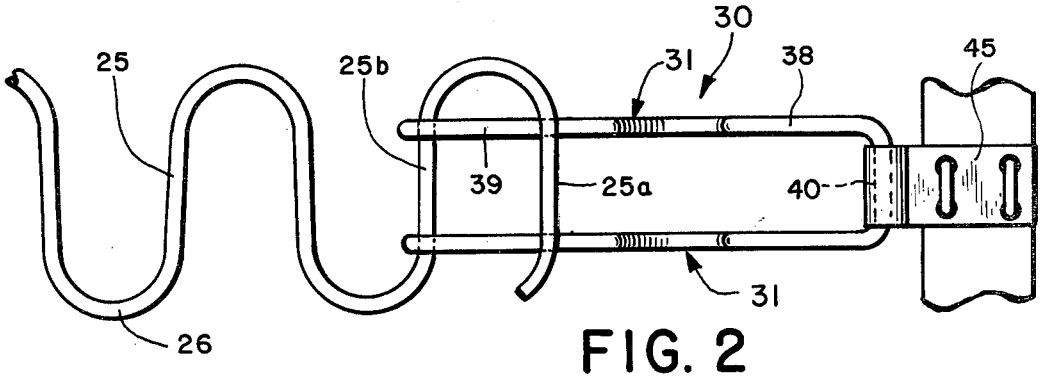
FIG. 2 is a view taken along line 22 of FIG. 1.

Referring now to the drawings, and particularly to FIGS. 1 and 2, a portion of the back end of a furniture seat base is illustrated generally at 10. The seat base 10 comprises spring band assemblies 15, only one of which is shown, extending in parallel relationship between the front rail (not shown) and back rail 16 of the base frame. Each assembly 15 includes a sinuous spring band 20 of standard loop size; i.e., a normal seven-eights ($\frac{7}{8}$) inch interval between linear segments 25 and semicircular segments 26 of the band. Each band 20 is connected to the back frame rail 16 by a first form of rail connector 30 embodying features of the invention.

The rail connector 30 is fabricated of spring steel wire of relatively heavy gauge; i.e., eight (8) gauge or heavier. As best illustrated in FIG. 2, it includes a pair of identical connector arms 31 extending parallel to each other between the rail 16 and the band 20.

As seen once again in FIG. 1, each connector arm 31 includes a generally V-shaped body 35 made up of a rail-side leg 36 and a spring-side leg 37. An angle of about 30° is defined between the legs, each of which is approximately one and one-quarter (1¼) inches long. It has been found that the angle may vary between 20° and 40° depending upon the elasticity desired in the connector 30. A smaller angle means greater elasticity.

Extending horizontally from the upper free end of each rail-side leg 36 is a rail-attachment leg 38. The rail-attachment legs 38 are preferably about one (1) inch long and are unitarily joined by a transversely extending base leg 40. In the assembly shown, the base leg 40 is seated in and attached to the rail 28 by a conventional EKS clip 45.

Inclined upwardly from the horizontal at an angle of more or less 30° and extending from the upper free ends of the spring-side legs 37 are spring-attachment legs 39. The spring-attachment legs 39 are approximately one and one-quarter (1¼) inches long.

The spring-attachment legs 39 have downwardly formed spring band attachment hooks 46 formed on their upper free ends. As illustrated, these hooks 46 overlie the penultimate linear segment **25*b* of the spring band and attach the rail connector 30 to the band. As such, the spring attachment legs 39, being approximately one and one-quarter (1¼) inches in length, extend downwardly under the ultimate linear segment 25*a* of the sinuous spring band 20 to their connection with corresponding spring-side legs 37 at a point slightly outwardly of and below the ultimate linear band segment 25*a***; i.e., approximately one-quarter (¼) inch.

In operation, the body 35 of the connector 30 is horizontally elastic. When a subject is seated on the seat base 10, the body 35 elastically expends and the seat is softened by this elasticity. At the same time, the connector 30 pivots downwardly about its base leg 40. Because of the flat surface-to-surface juncture between the base leg 40 and the EKS clip 45, this pivoting is noiseless.

Since the spring-attachment legs 39 are not pivotally connected to the band 20 but rather are rigidly mated with the ultimate and penultimate linear segments **25*a* and 25*b* thereof, and they extend approximately one-quarter (¼) inch downwardly and outwardly of the ultimate segment, they induce a downward torque in the back end of the band as the connector 30 pivots downwardly. In this first form of the connector 30 wherein these spring attachment legs 39 extend but a short distance outwardly and downwardly from the ultimate linear segment 25*a*** of the band, this torque is relatively smaller than in some of the other forms. However, it does induce a noticeable drop; i.e., "deep drop", in the back end of the band as the subject is seated.

This torque or moment-induced drop is referred to throughout the furniture industry as "deep-drop". It produces a seat which is more luxurious than those where no torque is induced because it tends to force the back end of the band downwardly as the subject is seated. This permits the subject to sit back comfortably in the chair seat rather than being inclined away from the back of the seat by an unhielding or only partially yielding connection between the sinuous spring bands and the back rail. When the subject arises from the seat, a reactive force in the spring thrusts the back end of the band upwardly in support of the rising subject, producing uplift or resilience under load. This is the type of luxury which has historically been attainable only in eight-way, hand-tied, coil springs.

Figure 3:
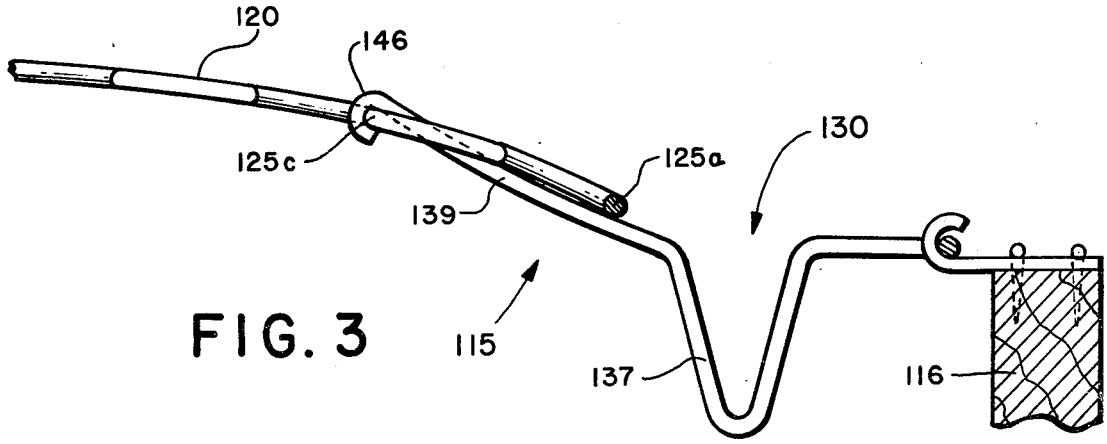
FIG. 3 is a view similar to FIG. 1 illustrating a second form of rail connector embodying features of the invention.

Turning now to FIG. 3, a sinuous spring band assembly 115 incorporating a second form of rail connector 130 embodying features of the invention is illustrated. Components of the spring assembly 115 have been identified with reference numerals corresponding to those of the components of the assembly 15, plus one hundred (100) digits, as will be noted.

The rail connector 130 is identical to the connector 30 hereinbefore described except for the dimensions of its spring-attachment legs 139 and the manner in which the connector is mated to the spring band 120. The spring-attachment legs 139 of the connector 130 are approximately two and one-quarter (2¼) inches long instead of approximately one and one-quarter (1¼) inches long. As a result, the downwardly formed hooks 146 on the free ends of the spring attachment legs 139 overlie and seat on the linear segment **125*c* of the sinuous spring band 120 which is third from the ultimate linear segment 125*a*. Accordingly, the attachment legs 139 will be seen to reach, in effect, upwardly into the body of the band, defining the chord of an arc between the linear segment 125*c* and 125*a***, the latter of which they support.

The effect of this construction is to introduce a component of horizontal compression in the body of the spring band 120 towards its center area. The fact that the spring-attachment legs 139 reach upwardly into the body of the band to the third linear segment **125*c*** causes this force component to be exerted. The result is to provide the internal compression known as arc-chord compression which causes an upward thrust of the spring band against a sitting subject when he or she rises. It also prevents bottoming and "oil canning" of the spring when the subject is seated.

Figure 4:
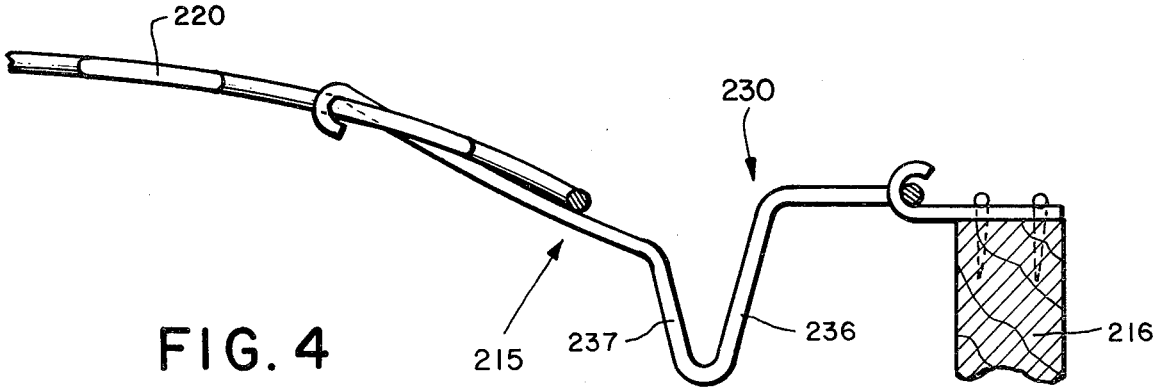
FIG. 4 is a view similar to FIG. 1 illustrating a third form of rail connector embodying features of the invention.

In FIG. 4, a sinuous spring band assembly 215 incorporating a third form of rail connector 230 embodying features of the present invention is illustrated. Components of the spring assembly 215 have been identified with reference numerals corresponding to those of the components of the assembly 115, plus one hundred (100) digits, as will be noted.

The rail connector 230 is identical to the connector 130 except for the dimensions of the spring side legs 237 and the manner in which the springs band 220 is, accordingly, positioned relative to the rail 216. As will be seen, the spring-side legs 237 are considerably shorter than the legs 137 of the connector 130. In practice, the legs 237 are approximately half their normal length; i.e., approximately five-eighths (⅝) inches long.

As previously pointed out, by making the spring-side legs 237 shorter than the rail-side legs 236, the elasticity of the connector 230 is reduced. Nevertheless, substantial elasticity is retained so that the benefits of horizontal elasticity are retained.

With the spring-side legs 237 of the connector 230 shortened in the aforedescribed manner the back end of the spring band 220 is lowered commensurately. This builds a downward incline or pitch into the spring band assembly 215. It will thus be seen that a furniture manufacturer can obtain pitch into his seat bases by merely using connectors 230 embodying features of the invention, all without losing the advantages of elasticity.

Figure 5:
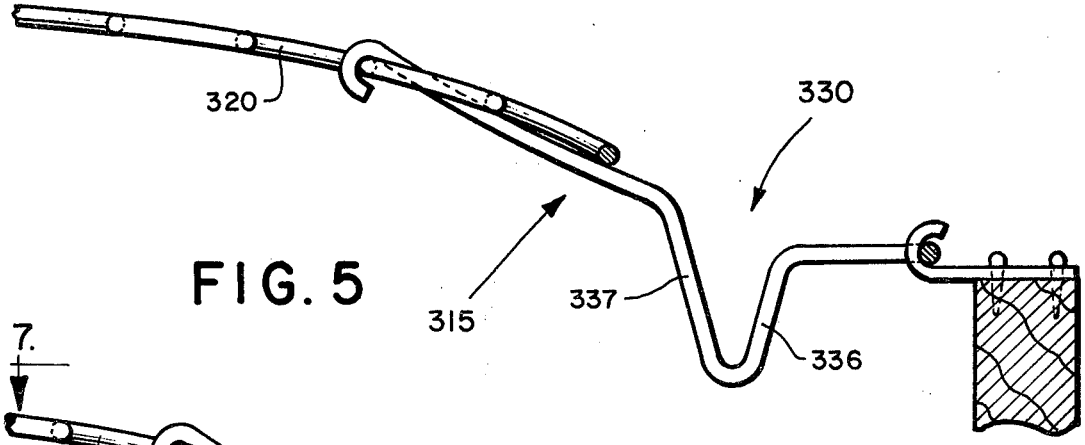
FIG. 5 is a view similar to FIG. 1 illustrating a fourth form of rail connector embodying features of the invention.

In FIG. 5, a sinuous spring band assembly 315 incorporating a fourth form of rail connector 330 embodying features of the present invention is illustrated. Components of the spring assembly 315 have been identified with reference numerals corresponding to those of the components of the assembly 115, plus two hundred (200) digits.

The rail connector 330 is identical to the connector 130 except for the dimensions of its rail side legs 336 and the manner in which the connector 330 acts on the spring band 320. The rail-side legs 336 are approximately half the length of the spring-side legs 337, as illustrated. In practice, they are approximately five-eights ($\frac{5}{8}$) inches long as compared with the approximately one and one-quarter ($1\frac{1}{4}$) inch length of the spring-side legs 337.

The effect is to make the connector 330 into a major torque member. The portion of the legs 337 above the axis of the rail attachment legs 338 act as crank arms. By introducing the substantial torque produced by this design to the back end of the spring band 320, a great amount of deep-drop in the back end of the spring band is effective when a subject is seated.

It will be seen that with the construction of the connector 330, the longer side legs 337 provide a greater longitudinal elasticity in the connector. At the same time, a greater amount of deep-drop is effected in the back of the spring band 320 because of the torquing effect of the longer side leg 337.

Figure 6:
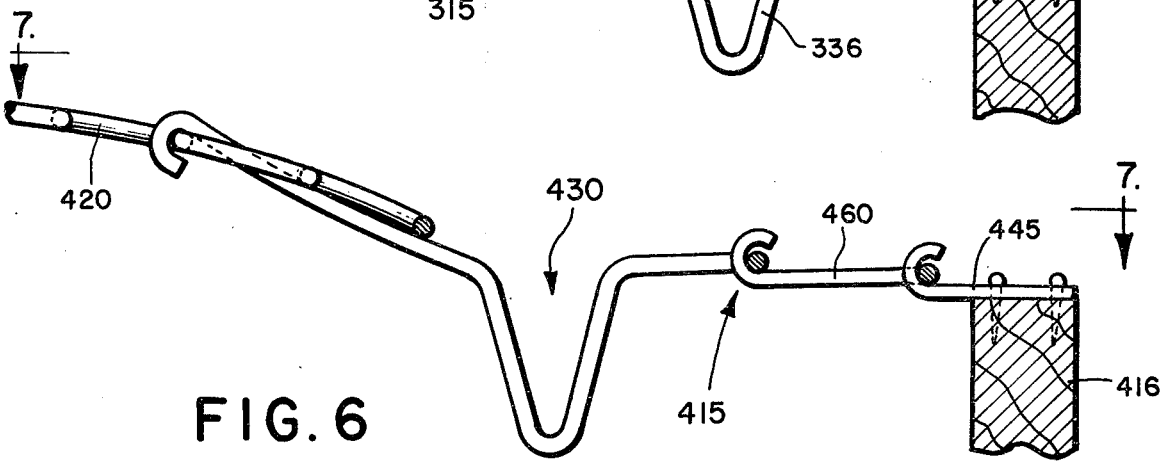
FIG. 6 is a view similar to FIG. 1 illustrating the second form of rail connector in a spring band assembly embodyin features of the invention.
Figure 7:
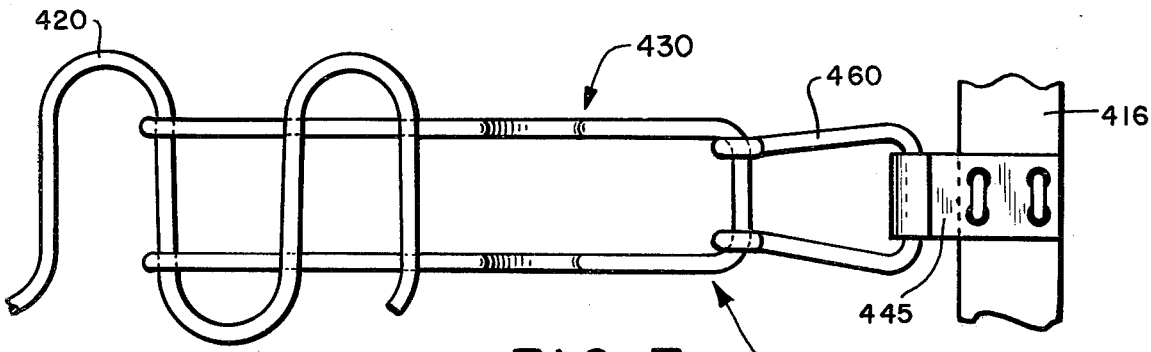
FIG. 7 is a view taken along line 7—7 of FIG. 6.

FIGS. 6 and 7 illustrate an improved spring band assembly 415 which incorporates a connector 430 identical to the connector 130 hereinbefore discussed. The spring band assembly 415 differs from the corresponding assembly 115 in that it includes a SWING ANCHOR attachment link 460 (trademark of Morely Furniture Spring Corporation, Chicago, Ill.) which joins the connector 430 to the frame rail 416 and thus provides for a downward translation of the connector 430 when a subject is seated.

The downward translation which occurs as a result of the swing anchor 460 pivoting downwardly about its joinder with the EKS clip 445 results in what is known in the industry as "initial-drop" of the back end of the spring band 420. This initial drop procedes the development of deep-drop caused by the minor moment arm connection of the connector 430 to the band 420. The deep-drop is enhanced by this initial-drop and the luxury seat feel correspondingly enhanced.

Figure 8:
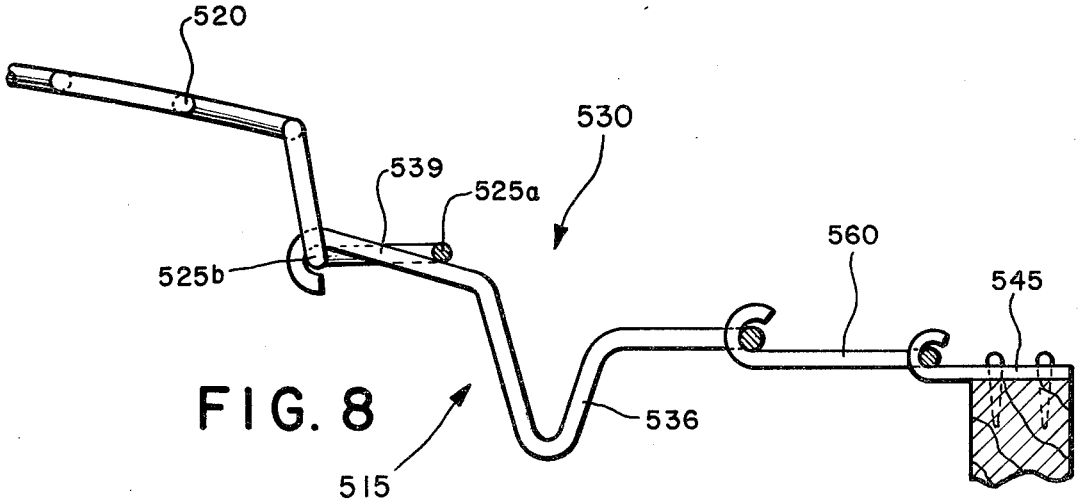
FIG. 8 is a view similar to FIG. 1 illustrating a modification of the fourth form of rail connector in another spring band assembly embodying feaures of the invention.

FIG. 8 illustrates another improved spring band assembly 515 incorporating a connector 530 which is a modification of the fourth form of connector 330 hereinbefore discussed. The assembly 515 differs further from the assembly 30 in that the back end of the spring band 520 is deformed in a manner corresponding to that described in Crosby et al. U.S. Pat. No. 3,388,904, to build a moment-arm effect into the body of the band itself. In addition, the connector 530 is pivotally mated with the EKS clip 545 on the rail 516 through a link 560, similar to the assembly of FIGS. 6 and 7.

The connector 530 has the shorter rail side legs 536 of the connector 330 whereby it also produces a substantial torquing effect on the back of the band 520. The spring attachment legs 539 of this connector 530 are shorter than those of the connector 330 so as to mate with the penultimate linear segment **525*b* and the ultimate linear segment 525*a***, as illustrated.

The cumulative effect of this assembly is to provide a torque-on-torque downward movement in the back end of the band 520. An even greater amount of deep-drop, and concomitant luxury seat feel, results. Coupled with the initial-drop introduced by the link 560 mating of the connector 530 to the frame, the present ultimate in back rail comfort in sinuous seat bases is the result.

Figure 9:
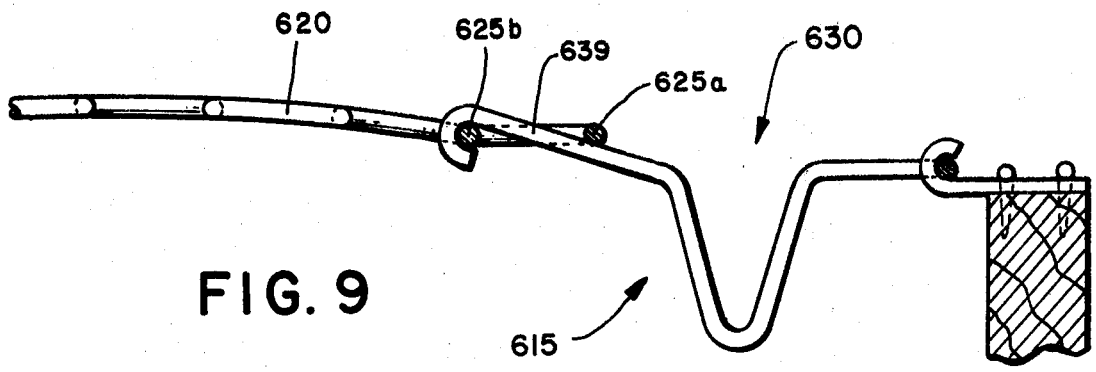
FIG. 9 is a view similar to FIG. 1 illustrating a modification of the first form of rail connector in still another spring band assembly embodying features of the invention.

FIG. 9 illustrates still another improved spring band assembly 615 incorporating a connector 630 very similar to the first form of connector 30 hereinbefore discussed. In the assembly 615, however, the spring band 620 is a largely de-arced band; i.e., unlike the most widely used sinuous which, in its relaxed state, actually rolls up or "arcs" into a circle, de-arced sinuous is very slightly arced in its relaxed state. De-arced sinuous is used in some furniture because it is faster to install, and gives a lower or flatter profile required by some types of seat bases.

The connector 630 differs from the connector 30 hereinbefore described by the angle at which its spring attachment legs 639 extend upwardly from the horizontal. A much lower angle, in the neighborhood of 15°, is utilized. The connector 630 then mates with the linear segments **625*a* and 625*b*** in the manner illustrated.

Figure 10:
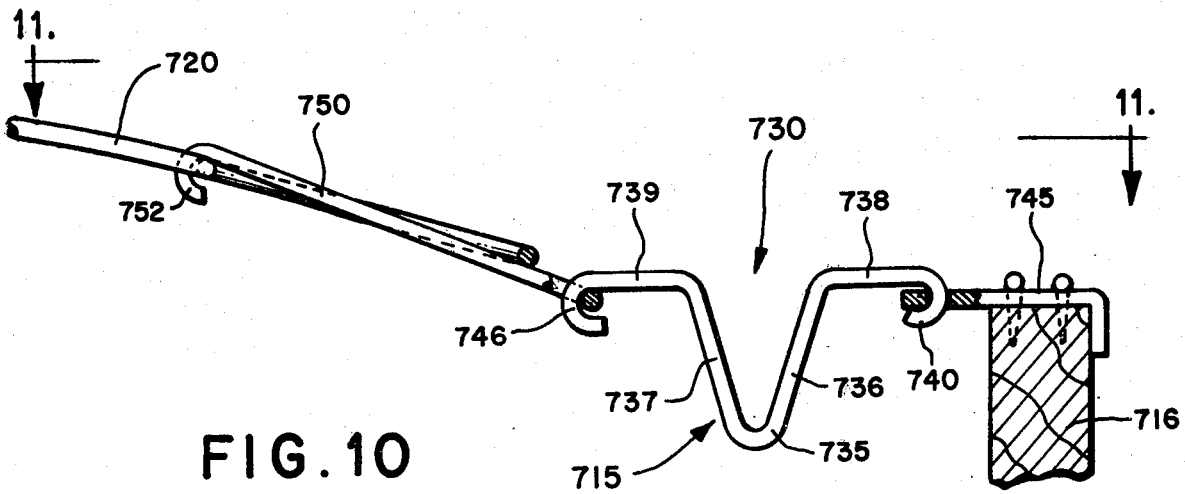
FIG. 10 is a view similar to FIG. 1 illustrating a fifth form of rail connector in yeat another spring band assembly embodying features of the invention.
Figure 11:
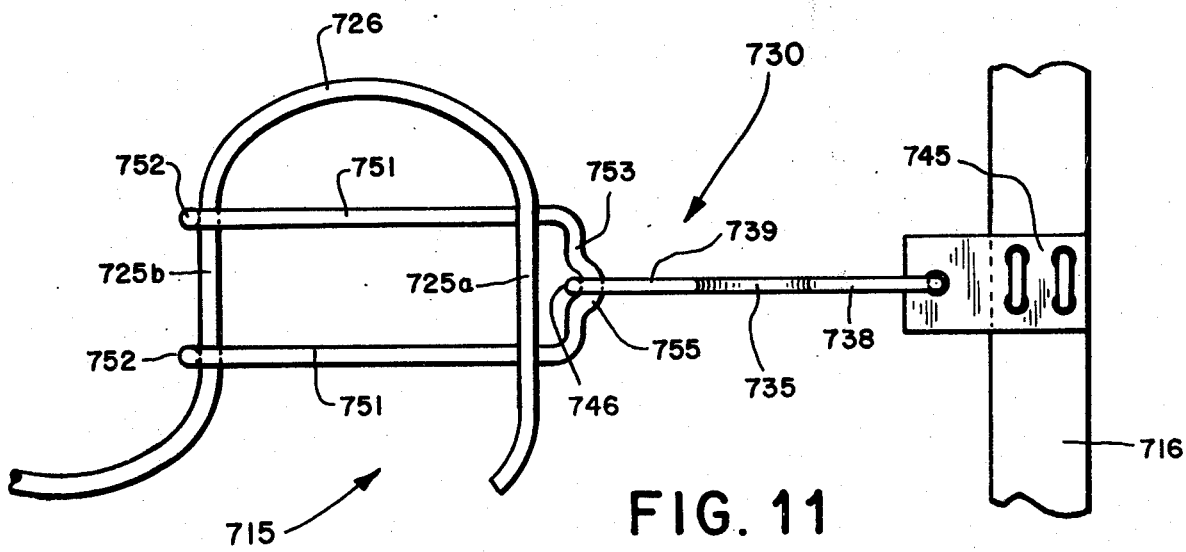
FIG. 11 is a view taken along line 11—11 of FIG. 10.

FIGS. 10 and 11 illustrate yet another improved spring band assembly 715 incorporating a fifth form of rail connector 730 embodying features of the invention. This is the simplest form of rail connector. It comprises a single V-shaped body 735 and is fabricated of heavy gauge, spring steel wire. The body 735 includes a rail-side leg 736 and a spring-side leg 737 which diverge at an angle of 40° in this illustration.

A normally horizontal rail-attachment leg 738 extends toward the rail 716 from the free end of the rail-side leg 736. It is a hook 740 formed on its outer end and this hook mates with and pivotally connects the springs band 720 to an L-clip 745 seated on the rail 716.

A normally horizontal spring-attachment leg 739 extends toward the spring band 720 from the free end of the spring side leg 737. It has a hook 746 formed thereon and this hook seats on and pivotally connects the rail 716 to the band 720 through a torque arm 750.

The band 720 is a super-loop sinuous band; i.e., its component loops formed of linear segments 725 and semi-circular segments 726 measure approximately two (2) inches across. The torque arm 750 comprises a hardened spring wire member having parallel legs 751 with downwardly formed hooks 752 on their free inner ends. A transverse base leg 753 connects the other ends of the parallel legs 751.

The hooks 752 seat over and mate with the penultimate linear segment **725*b*. The parallel legs 751 extend outwardly under and support the ultimate linear segment 725*a*. The legs 751 are of such length that the base leg 753 is disposed approximately one-half ($\frac{1}{2}$) inch to one (1) inch outward and downward of the penultimate linear band segment 725*a***.

The base leg 753 has a dimple 755 formed outwardly of it, toward the rail 716, at its mid-point. The hook 746 on the connector 730 seats on the base leg 753 of the torque arm 750 in this dimple 755.

In operation, the spring assembly 715 exerts a moment-arm downwardly on the back end of the band 720 through the torque arm 750. Deep drop in the back end of the seat is produced. The connector 730 introduces horizontal elasticity which contributes to the seat's performance. It also permits the band 720 to drop down initially through the arcuate pivoting action of the connector 730. This produces the aforedescribed initial-drop which ideally precedes deep-drop and further adds to the luxury feel of the seat.

Figure 12:
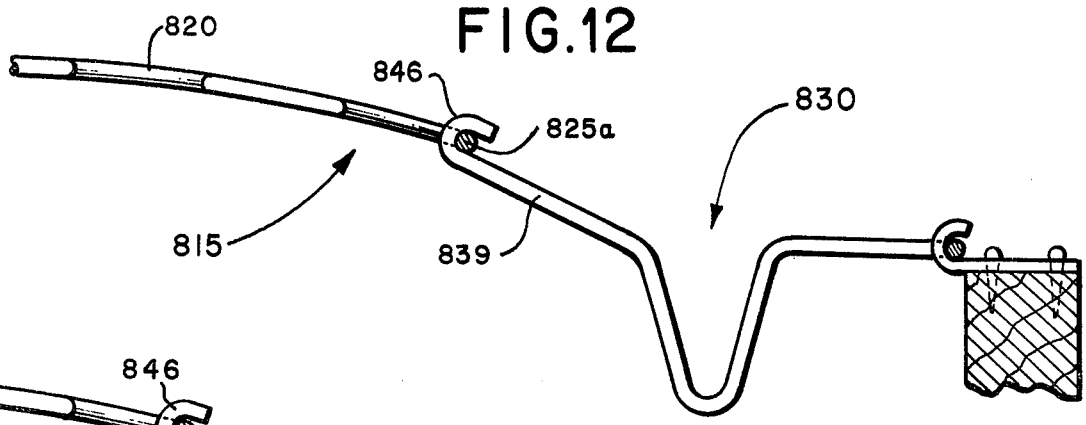
FIG. 12 is a view similar to FIG. 1, illustrating a sixth form of rail connector in yet another spring band assembly embodying features of the invention.

Referring to FIG. 12, a sixth form of rail connector 830 in another spring band assembly 815 is illustrated.

The connector 830 is identical to the connector 30 hereinbefore described except that spring band attachment hooks 846 are formed upwardly on the free ends of spring attachment legs 839. The assembly 815 is identical to the assembly 15 except that the hooks 846 seat on the ultimate or endmost linear segment 825*a* of the band 820.

Figure 13:
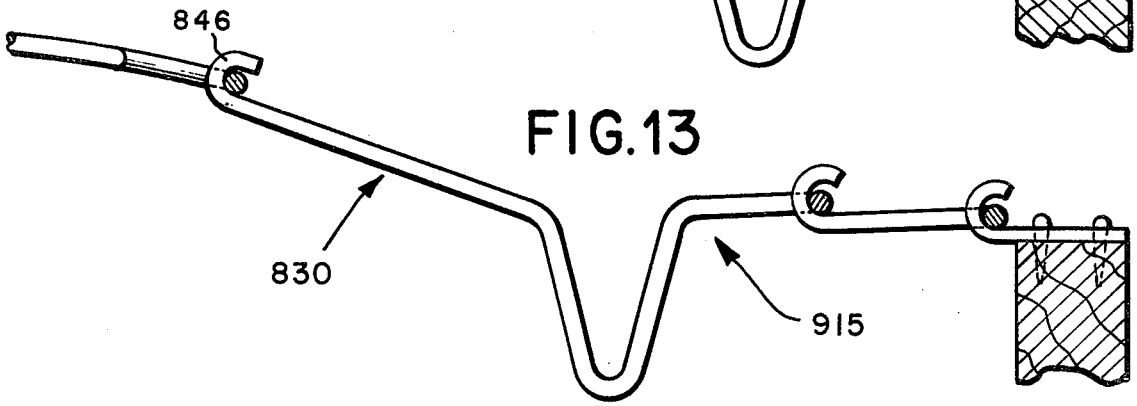
FIG. 13 is a view similar to FIG. 6 illustrating a modification of the assembly shown therein.

Referring to FIG. 13, the connector 830 is illustrated in a band assembly 915 similar to the one illustrated at 415 in FIGS. 6 and 7. The upwardly formed hook 846 again seat on the ultimate linear segment of the spring band.

Figure 14:
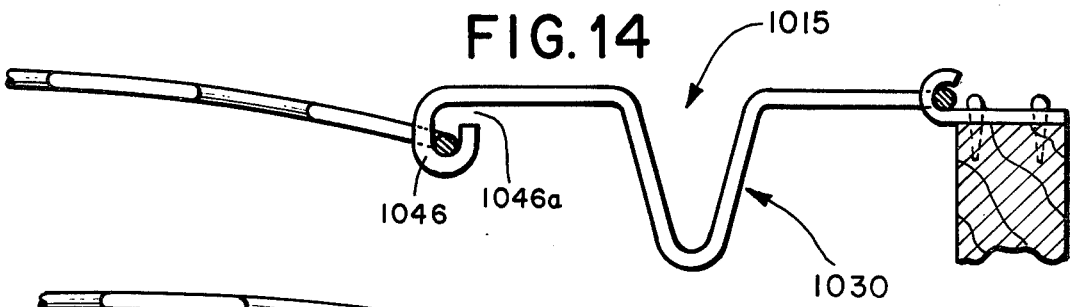
FIG. 14 is a view similar to FIG. 1, illustrating another modification of the rail connector illustrated in FIG. 1.

FIG. 14 illustrates another modification of the rail connector 30 in the form of the rail connector 1030. As will readily be recognized, the connector 1030 has its attachment hooks 1046 formed downwardly, but the hooks are specially formed to define a 270° arc and leave only a 90° opening 1046*a* in their upper right hand quadrants. This construction effects a locking of the ultimate band segment in the hooks 1046; i.e., it will not pop out regardless of the shock loads to which the assembly 1015 is subjected.

Figure 15:
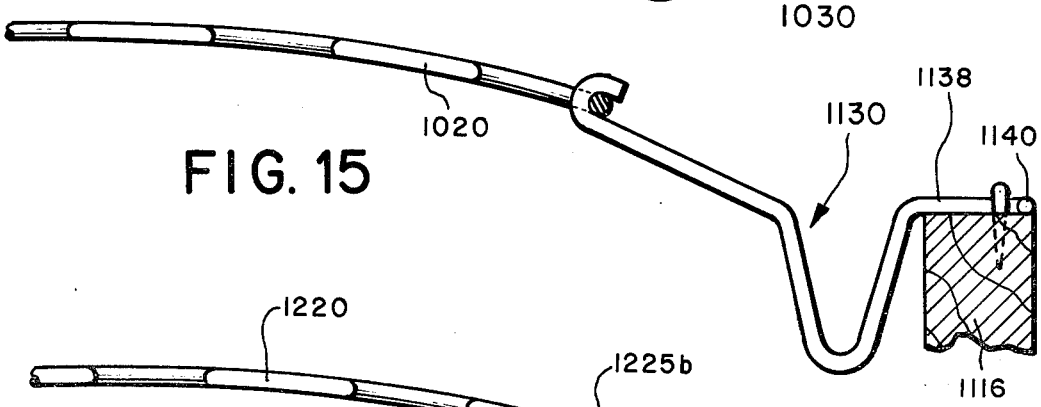
FIG. 15 is a view similar to FIG. 12, illustrating a modification of the spring band assembly illustrated therein.

FIG. 15 illustrates a rail connector 1130 identical to that illustrated in FIG. 12. Here, however, the rail attachment legs 1138 and base leg 1040 are stapled securely to the rail 1028. As a result the connector 1130 does not pivot at its connection with the rail 1028. Uplift of the band 1020 at its back end is provided by stored energy in the generally V-shaped connector 1130 when it is deformed downwardly under load.

Figure 16:
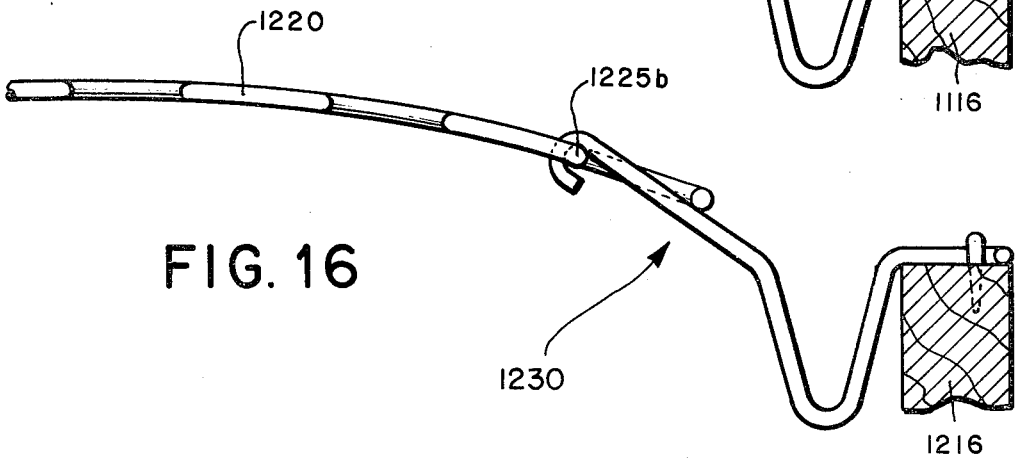
FIG. 16 is a view similar to FIG. 9 illustrating a modification of the spring band assembly illustrated therein.

FIG. 16 illustrates a rail connector 1230 identical to that illustrated in FIG. 9, attached to the spring band 1220 in the same way. The connector 1230 is, in turn, secured to the rail 1228 in a manner identical to connector 1130 illustrated in FIG. 15. The connector 1230, in reaching up into the band 1220 to seat on the penultimate linear segment 1225*b*, introduce a torsion effect in the rear of the band where a subject is seated. The salutary effects have been previously discussed at length.

Various forms of the invention have been discussed in association with regular loop sinuous and with superloop, de-arced sinuous. It will readily be understood by those of ordinary skill in this art that the invention will find advantageous application with X-L sinuous, in many instances, both arced and de-arced, as well.

As pointed out at the outset, the description of various forms of the invention is in terms of its sinuous spring band application. Rail connectors embodying many forms of the invention may also be used to great advantage in connecting Flexolators Inc. wire grid spring bases, known as perma L, Pirelli type chord-rubber bands, and flexible steel bands to seat frame rails, however. For example, the rail connectors of FIG. 12 are used in this capacity.

Throughout this description the connectors have been described as generally V-shaped. As illustrated, the V-shaped configuration takes the form of an apex which is actually bent in an arc. The radius of the arc must be at least as great as the diameter of the connector wire.

While several embodiments described herein are at present considered to be preferred, it is understood that various modifications and improvements may be made therein, and it is intended to cover in the appended claims all such modifications and improvements as fall within the true spirit and scope of the invention.

I claim:

1. In a furniture seat base including a frame having a front rail and a back rail and a plurality of sinuous spring band assemblies disposed between said rails, the improvement in a sinuous spring band assembly, comprising:

a. a normally arced sinuous spring band comprising a plurality of generally linear wire segments interconnected by a plurality of generally semi-circular wire segments connected to the front rail and extending into close proximity with the back rail, b. a rail connector connecting said band to the back rail, c. said rail connector having a V-shaped body with rail side leg means and spring side leg means directly joined at an apex at corresponding one ends and diverging to opposite free ends, d. rail attachment leg means joined to the free end of said rail side leg means and pivotally connected to the back rail, e. spring attachment leg means joined to the free end of said spring side leg means and connected to the back end of said sinuous spring band, f. said spring attachment leg means underlying the linear wire segment at the back end of said band and overlying a linear wire segment inwardly of the back end of said band so as to exert a torque effect tending to flatten the arc of said normally arced band.

2. The improvement in a sinuous spring band assembly of claim 1 further characterized in that:

a. said rail side leg means, said spring side leg means, said rail attachment leg means, and said spring attachment leg means each comprise parallel legs of the same length formed of the same piece of hardened steel wire.

3. The improvement in a sinuous spring band assembly of claim 2 further characterized in that:

a. said rail connector includes a base leg joining said parallel rail attachment legs and formed from said piece of hardened steel wire, b. said base leg being pivotally mounted on the back rail.

4. The improvement in a sinuous spring band assembly of claim 2, further characterized in that:

a. said rail side legs are substantially shorter than said spring side legs.

* * * * *